United States Patent [19]

Sethi et al.

[11] Patent Number: 4,738,949

[45] Date of Patent: Apr. 19, 1988

[54] HIGH-SECURITY IDENTIFICATION CARD OBTAINED BY THERMAL DYE TRANSFER

[75] Inventors: Gurdip S. Sethi, Rochester; Stephen D. Marshall, Hamlin; David E. Wenschhof, Victor, all of N.Y.

[73] Assignee: Eastman Kodak Company, Rochester, N.Y.

[21] Appl. No.: 947,052

[22] Filed: Dec. 29, 1986

[51] Int. Cl.[4] ..... B41M 5/26; B41M 3/14

[52] U.S. Cl. ..... 503/227; 8/471; 283/94; 283/95; 427/146; 427/256; 428/195; 428/412; 428/480; 428/913; 428/914; 428/915; 428/916

[58] Field of Search ..... 8/470, 471; 503/227; 427/146, 256; 428/195, 913, 914, 915, 916, 412, 480; 283/94, 95

[56] References Cited

U.S. PATENT DOCUMENTS 4,629,215 12/1986 Maurer et al. ..... 283/94

*Primary Examiner*—Bruce H. Hess

*Attorney, Agent, or Firm*—Harold E. Cole

[57] ABSTRACT

A dye-receiving element and process for producing a high-security, monolithic identification card, the element comprising a support having thereon a dye image-receiving layer adapted to receive a thermally-transferred dye image, the dye image-receiving layer containing indicia printed thereon approximately 40–120 μm in width.

20 Claims, No Drawings

HIGH-SECURITY IDENTIFICATION CARD OBTAINED BY THERMAL DYE TRANSFER

This invention relates to dye-receiving elements for producing high-security, monolithic identification (ID) cards, assemblages thereof and processes for obtaining same.

The use of ID cards is growing in importance all over the world for use as drivers licenses, national ID cards, student cards, passports, security clearance cards, etc. Considering the ease by which some cards can be made, there is a need for a high-security card made using advanced technology which cannot be tampered with or forged.

There are usually two types of "printing" made on ID cards. The first type of printing involves a "background" printing made up of reference and security information. The reference information may include, for example, the issuing agency, as well as other numerical data. The security information may be in the form of a watermark, an encoded magnetic strip, numerical sequences, a holographic image, etc. The second type of printing is made up of "personalized" information, such as a photograph, fingerprint, signature, name, address, etc.

One of the systems currently available makes use of a sequential or simultaneous multiple photographic exposure of both the background and personalized information by using conventional photography. There are problems with this system in that it is a wet process, it involves centralized processing so that the card is not available "instantly", and it is not a high-security system, since ordinary photography is used and such materials and skills are easily duplicated.

Another available system involves printing the background information either before or after a photograph is affixed. There are problems with this system also. If a photograph is laminated onto the surface of the ID card, then it can be altered by merely replacing the photograph. If the photograph is part of the card stock itself, then the printing of the background information is difficult since it is hard to print over the photographic gelatin surface of the card stock. Also, if a mistake is made in the printing, then the photograph has to be retaken. In addition, the system is a wet process and is not available "instantly".

Another available system involves printing the background information on a paper support, using the diffusion transfer method to obtain the personalized information such as a photograph on another support, and then transferring the photograph onto the paper support. There are the same problems of alteration and wet processing with this system as described above. In addition, most of these systems are black-and-white and any color images obtained by this method are of poor quality.

Another available system uses conventional lithographic printing of background information on paper, followed by an electrophotographic process to obtain the personalized information or photograph. The photographs obtained by this system are usually black-and-white, however, are not continuous tone and are generally of poor quality.

It would be desirable to provide a "secure" card stock, one not easily duplicated, and which could be used to produce a high-security, monolithic ID card. It would also be desirable to provide an ID card by a process which is dry and available instantly. It would also be desirable to provide such a card containing personalized printing, such as a photograph, on top of fine-line background printing so that the card could not be forged.

These and other objects are achieved in accordance with this invention which comprises a dye-receiving element for producing a high-security, monolithic identification card, the element comprising a support having thereon a dye image-receiving layer adapted to receive a thermally-transferred dye image, and wherein the dye image-receiving layer contains indicia printed thereon approximately 40–120 μm in width.

The indicia printed on the card can take the form of lines, line segments, dots, letters, (200–250 μm high) characters, logos, guilloches, etc. The important feature is to have fine-line distinctive markings which cannot be easily duplicated.

The above dye-receiving element is in fact a "secure" card stock since (a) a "secure" material is used as the coated element, i.e., one that is not easily obtainable, and (b) the element contains a fine-line security printing, i.e., one that can identify the issuer, be sequentially numbered if desired and thus is more difficult to counterfeit.

The dye-receiving element described above containing a dye-image receiving layer is security-printed using fine-line indicia approximately 40–120 μm in width. The lines may be printed to a thickness of approximately 1 to 2 μm using, for example, a rotary letterpress or offset printing press.

In general, a lay-down thickness of ink of about 1 to 2 μm or less is needed to retain integrity of subsequent thermal printing over the fine-line security printing. If the ink thickness becomes too great, halos around the fine-lines are observed in thermally printed areas of low to moderate density. Casual or inadvertent removal of the fine-line pattern also becomes more severe as ink indicia line width is increased.

While a variety of inks can be printed onto a receiving layer, the ink should be fully cured or affixed to the layer so as not to be randomly removed during the subsequent thermal printing which would destroy the security pattern. In a preferred embodiment of the invention, ultraviolet-curable inks are employed. Examples of such inks include Sanford Letter Press, Inc. Ink numbers: Black—00373981-10; Cyan—00373982-08; Magenta—00388462-07; and Red—0102-8-86; and IPI Inmont Co. Inks with the general specification number of 85EOO. Inks may be varied to produce rainbow (varying color) hues, pastel shades, and ultraviolet light absorbers.

After printing, the card stock is cured, for example, using two 300 watt high-pressure mercury vapor lamps, at a 4-inch distance, for ¾ sec. time at each of three drier units. By curing the ink in this manner, the fine lines are prevented from being abraded off by handling.

The dye image-receiving element is then used in a thermal dye-transfer process to obtain the personalized printing or photograph necessary for a high-security, monolithic ID card. By "monolithic" is meant that the photograph or other personalized information is contained in the same layer as the background information. In that way, any tampering with the photograph will destroy the background information and forgeries can be prevented. The card stock can be made secure by sequential numbering and controlling the distribution carefully such as would be done for bank notes.

As noted above, personalization of the card stock is done with a thermal dye-transfer process to make the monolithic card. By using the thermal dye-transfer process, a print can be obtained from an image which has been generated electronically from a color video camera. According to one way of obtaining such prints, an electronic image is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original image viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

Alternatively, three separate thermal printing heads, each with its own continuous supply of dye-donor element, could be used for sequential printing. This would be particularly advantageous for a high-volume output such as would occur at a centralized location operation.

As described above, the dye-receiving element of the invention comprises a support having thereon a dye image-receiving layer and the printed fine lines. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek®. In a preferred embodiment, polyester with a white pigment incorporated therein is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

In a preferred embodiment, a polycarbonate dye image-receiving layer is used which has a number average molecular weight of at least about 25,000. The term "polycarbonate" as used herein means a polyester of carbonic acid and glycol or a divalent phenol. Examples of such glycols or divalent phenols are p-xylene glycol, 2,2-bis(4-oxyphenyl)propane, bis(4-oxyphenyl)methane, 1,1-bis(4-oxyphenyl)ethane, 1,1-bis(oxyphenyl)butane, 1,1-bis(oxyphenyl)cyclohexane, 2,2-bis(oxyphenyl)butane, etc.

In an especially preferred embodiment of the invention, the polycarbonate is a bisphenol A polycarbonate. In another preferred embodiment of the invention, the bisphenol A polycarbonate comprises recurring units having the formula:

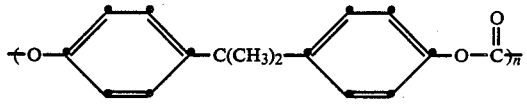

wherein n is from about 100 to about 500.

Examples of such polycarbonates include: General Electric Lexan® Polycarbonate Resin #ML-4735 (Number average molecular weight app. 36,000), and Bayer AG, Makrolon #5705® (Number average molecular weight app. 58,000).

The thermally-printed card may also be laminated for further durability, protection and security using materials such as those available from Datacode Systems (Division of Graphic Laminating) or those described in U.S. application Ser. No. 947,053 of Harrison entitled "Adhesives For Laminating Thermal Print Elements" filed of even date herewith.

A dye-donor element that is used with the dye-receiving element of the invention comprises a support having thereon a dye layer. Any dye can be used in such a layer provided it is transferable to the dye image-receiving layer of the dye-receiving element of the invention by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

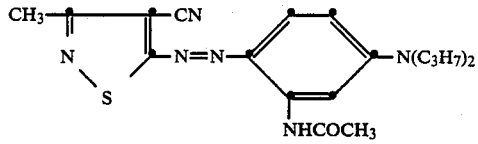

(magenta)

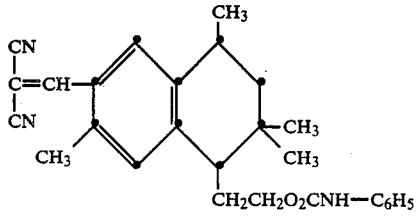

(yellow)

-continued (cyan)

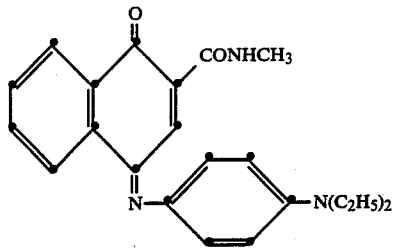

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 μm. It may also be coated with a subbing layer, if desired.

A dye-barrier layer comprising a hydrophilic polymer may also be employed in the dye-donor element between its support and the dye layer which provides improved dye transfer densities. Such dye-barrier layer materials include those described and claimed in application Ser. No. 813,294 entitled "Dye-Barrier Layer for Dye-Donor Element Used in Thermal Dye Transfer" by Vanier et al, filed Dec. 24, 1985.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

As noted above, dye-donor elements are used to form a dye transfer image. Such a process comprises image-wise-heating a dye-donor element and transferring a dye image to a dye-receiving element as described above to form the dye transfer image.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

The dye-donor element employed in certain embodiments of the invention may also contain a release agent as disclosed in U.S. application Ser. No. 934,290 by Vanier, entitled "Release Agent for Thermal Dye Transfer" filed Nov. 24, 1986.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements employed in the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to illustrate the invention.

EXAMPLE (A) A yellow dye-donor element was prepared by coating the following layers in the order recited on a 6 μm poly(ethylene terephthalate) support:

(1) Dye-barrier layer of gelatin nitrate (gelatin, cellulose nitrate and salicylic acid in approximately 20:5:2 weight ratio in a solvent of acetone, methanol and water) (0.17 g/m$^2$), (2) Dye layer containing the following yellow dye (0.39 g/m$^2$) in cellulose acetate (40% acetyl) (0.38 g/m$^2$) coated from 2-butanone, acetone and cyclohexanone (14:8:1) solvent:

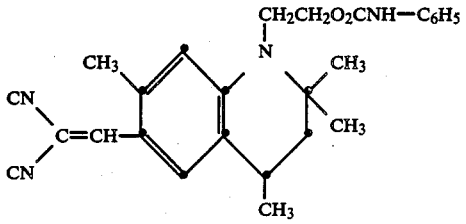

On the back side of the element, a slipping layer of poly(vinyl stearate) (0.3 g/m$^2$) in polyvinylbutyral (Butvar-76® Monsanto) (0.45 g/m$^2$) was coated from tetrahydrofuran solvent.

(B) A magenta dye-donor element was prepared similar to (A) except that the dye layer (2) comprised the following magenta dye (0.22 g/m$^2$) in cellulose acetate hydrogen phthalate (0.38 g/m$^2$) coated from 2-butanone, acetone and cyclohexanone (14:4:1) solvent:

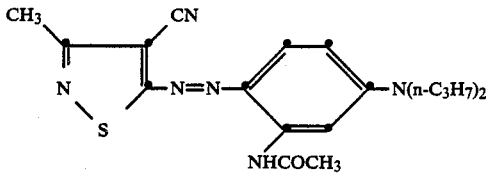

(C) A cyan dye-donor element was prepared similar to (A) except that the dye layer (2) comprised the following cyan dye (0.37 g/m$^2$) in cellulose acetate hydrogen phthalate (0.42 g/m$^2$) coated from 2-butanone, acetone and cyclohexanone (14:4:1) solvent:

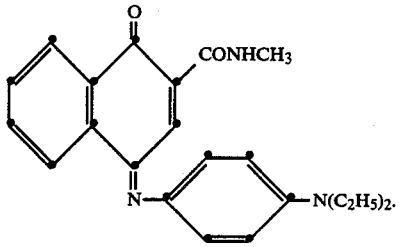

A dye-receiving element was prepared by coating a solution of Makrolon 5705® (a bisphenol A polycarbonate resin from Bayer AG) from a methylene chloride and trichloroethylene solvent mixture at a coverge of 2.9 g/m$^2$ on top of an ICI Melinex® "White Polyester" reflective support:

A fine-line security feature of lines 70–120 μm in width was printed to a thickness of approximately 1 μm with Sanford Letterpress Inc. inks using a rotary letterpress onto the dye-receiving element described above. The printed element was then cured using two 300 watt high-pressure mercury vapor lamps, at a 4-inch distance, for ¾ sec. at each of three drier units.

The personalization printing was done by thermally overprinting a digitized electronic multicolor image onto the above card stock by sequential use of individual yellow, magenta and cyan dye-donor elements as described in the following manner.

The dye side of each dye-donor element strip 3 inches (75 mm) wide was placed in contact with the dye image-receiving layer side of the printed card stock. The assemblage was fastened in the jaws of a stepper motor driven pulling device. The assemblage was laid on top of a 0.55 (14 mm) diameter rubber roller and a Fujitsu Thermal Head (FTP-040MCS001) and was pressed with a spring at a force of 3.5 pounds (1.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were heated at controlled times from 0 to 4.5 msec to generate a continuous tone personalized test image. The voltage supplied to the print head was approximately 19 v representing approximately 1.75 watts/dot. Further details of the apparatus used are contained in U.S. Pat. No. 4,621,271 discussed above.

The above process was repeated for each color to obtain a high-security, monolithic, multicolor ID card by a dry process.

The invention has been described in detail with particular reference to preferred embodiments thereof, but it will be understood that variations and modifications can be effected within the spirit and scope of the invention.

What is claimed is:

1. A dye-receiving element for producing a high-security, monolithic identification card, said element comprising a support having thereon a dye image-receiving layer adapted to receive a thermally-transferred dye image, said dye image-receiving layer containing indicia printed thereon approximately 40–120 μm in width.

2. The element of claim 1 wherein said dye image-receiving layer comprises a polycarbonate having a number average molecular weight of at least about 25,000.

3. The element of claim 1 wherein said lines are printed with an ultraviolet-curable ink.

4. The element of claim 1 wherein said lines are printed using a letterpress or offset printing press to produce a lay-down thickness of ink of about 1 to 2 μm.

5. The element of claim 1 wherein said support is poly(ethylene terephthalate) having a white pigment incorporated therein.

6. A process of producing a high-security, monolithic identification card comprising:

(a) printing indicia approximately 40–120 μm in width onto a dye-receiving element comprising a support having thereon a dye image-receiving layer;

(b) imagewise-heating a dye-donor element comprising a support having thereon a dye layer; and (c) transferring a dye image to said dye-receiving element to form said high-security, monolithic identification card.

7. The process of claim 6 wherein said dye image-receiving layer comprises a polycarbonate having a number average molecular weight of at least about 25,000.

8. The process of claim 6 wherein said lines are printed with an ultraviolet-curable ink.

9. The process of claim 6 wherein said lines are printed using a letterpress or offset printing press to produce a lay-down thickness of ink of about 1 to 2 μm.

10. The process of claim 6 wherein said support of said dye-receiving element is poly(ethylene terephthalate) having a white pigment incorporated therein.

11. The process of claim 6 wherein said support for the dye-donor element comprises poly(ethylene terephthalate) which is coated with sequential repeating areas of cyan, magenta and yellow dye, and said process steps (b) and (c) are sequentially performed for each color to obtain a three-color dye transfer image.

12. A high-security, monolithic identification card comprising a support having thereon printed indicia approximately 40–120 μm in width and a dye image-receiving layer containing a thermally-transferred dye image.

13. The card of claim 12 wherein said dye image-receiving layer comprises a polycarbonate having a number average molecular weight of at least about 25,000.

14. The card of claim 12 wherein said lines are printed with an ultraviolet-curable ink.

15. The card of claim 12 wherein said lines are printed using a letterpress or offset printing press to produce a lay-down thickness of ink of about 1 to 2 μm.

16. The card of claim 12 wherein said support is poly(ethylene terephthalate) having a white pigment incorporated therein.

17. The card of claim 12 wherein said thermally-transferred dye image comprises cyan, magenta and yellow dyes.

18. A thermal dye transfer assemblage comprising:

(a) a dye-donor element comprising a support having thereon a dye layer comprising a dye dispersed in a binder, and (b) a dye-receiving element comprising a support having thereon a dye image-receiving layer, said dye-receiving element being in a superposed relationship with said dye-donor element so that said dye layer is in contact with said dye image-receiving layer, said dye image-receiving layer containing indicia printed thereon approximately 40–120 μm in width.

19. The assemblage of claim 18 wherein said support of said dye-receiving element is poly(ethylene terephthalate) having a white pigment incorporated therein and said dye image-receiving layer comprises a polycarbonate having a number average molecular weight of at least about 25,000.

20. The assemblage of claim 18 wherein said lines are printed with an ultraviolet-curable ink using a letterpress or offset printing press to produce a lay-down thickness of ink of about 1 to 2 μm.

* * * * *